US012656016B2

(12) United States Patent
Griffin et al.

(10) Patent No.: US 12,656,016 B2
(45) Date of Patent: Jun. 16, 2026

(54) COMMERCIAL KITCHEN INSTALLATION WITH DOUBLE WALL GREASE DUCT

(71) Applicant: Captive-Aire Systems, Inc., Raleigh, NC (US)

(72) Inventors: William Brian Griffin, Columbia, PA (US); Nicholas I. Perry, Warrington, PA (US); Kyle D. Thompson, Lancaster, PA (US)

(73) Assignee: Captive-Aire Systems, Inc., Raleigh, NC (US)

( * ) Notice: Subject to any disclaimer, the term of this patent is extended or adjusted under 35 U.S.C. 154(b) by 947 days.

(21) Appl. No.: 17/690,249

(22) Filed: Mar. 9, 2022

(65) Prior Publication Data

US 2022/0196280 A1 Jun. 23, 2022

Related U.S. Application Data

(63) Continuation of application No. 16/868,610, filed on May 7, 2020, now Pat. No. 11,300,317.

(51) Int. Cl.

| | |
|---|---|
| ***F24F 13/02*** | (2006.01) |
| ***E04B 1/74*** | (2006.01) |
| ***F24C 15/20*** | (2006.01) |
| ***F24C 15/34*** | (2006.01) |

(52) U.S. Cl.

CPC ..... *F24F 13/0263* (2013.01); *E04B 1/74* (2013.01); *F24C 15/20* (2013.01); *F24C 15/34* (2013.01); *E04B 2001/742* (2013.01)

(58) Field of Classification Search

CPC ... F24F 13/0216; F24F 13/0263; F24C 15/20; F24C 15/34; E04B 1/74; E04B 2/001742; E04B 1/38; E04B 2001/742; E04B 1/7604; F16L 59/14; F16L 59/15; F16L 21/08;

(Continued)

(56) References Cited

U.S. PATENT DOCUMENTS 822,963 A * 6/1906 Little ..... A47B 91/06 16/DIG. 39

3,596,587 A 8/1971 Klinger (Continued)

FOREIGN PATENT DOCUMENTS

DE 3718930 A1 * 12/1988 ..... F16L 59/05

EP 0356613 A1 * 5/1990 ..... F17C 3/04

(Continued)

OTHER PUBLICATIONS

Merriam Webster, Seal Definition, 2 pages, https://www.merriam-webster.com/dictionary/seal.*

(Continued)

*Primary Examiner* — Michael G Hoang

*Assistant Examiner* — Elizabeth Ann Laughlin

(74) *Attorney, Agent, or Firm* — COATS & BENNETT, PLLC

(57) ABSTRACT

A grease duct assembly is employed in a commercial kitchen. The grease duct assembly includes multiple sections that are connected together and sealed. Each section includes a double wall construction that forms a central conduit and an annular space that extends between an inner wall and an outer wall. Shredded insulation is directed into the annular space and compressed therein.

8 Claims, 9 Drawing Sheets

(58) Field of Classification Search
CPC ..... F16L 59/04; E04F 21/085; E04F 21/14; E04F 21/12; Y10S 62/13
USPC ..... 126/1 F
See application file for complete search history.

(56) References Cited

U.S. PATENT DOCUMENTS

| | | | | | |
|---|---|---|---|---|---|
| 3,889,581 | A * | 6/1975 | Bray | B01D 47/06 | 98/115 |
| 4,086,847 | A | 5/1978 | Overmyer | | |
| 4,306,491 | A | 12/1981 | Reardon, Jr. | | |
| 4,543,677 | A * | 10/1985 | Haglund | F24F 13/0263 | 138/155 |
| 4,787,298 | A | 11/1988 | Hon | | |
| 5,253,636 | A | 10/1993 | Glover et al. | | |
| 5,462,238 | A * | 10/1995 | Smith | B02C 18/2283 | 241/292.1 |
| 5,722,388 | A | 3/1998 | Butow et al. | | |
| 5,738,148 | A | 4/1998 | Coral et al. | | |
| 6,062,270 | A | 5/2000 | Hultberg et al. | | |
| 6,543,575 | B1 | 4/2003 | Marcellus | | |
| 6,579,170 | B1 | 6/2003 | Davis | | |
| 7,798,891 | B2 | 9/2010 | Stubbert et al. | | |
| 8,245,381 | B2 | 8/2012 | Potter et al. | | |
| 8,667,995 | B1 | 3/2014 | Fanelli | | |
| 10,041,687 | B1 | 8/2018 | Caneba | | |
| 2003/0228839 | A1 | 12/2003 | Ferlin | | |
| 2012/0017883 | A1 | 1/2012 | Campen et al. | | |
| 2016/0258577 | A1 * | 9/2016 | Blanchard et al. | F17C 3/04 | |
| 2019/0293301 | A1 * | 9/2019 | Rediger et al. | F24C 15/20 | |

FOREIGN PATENT DOCUMENTS

| | | | | |
|---|---|---|---|---|
| EP | 1600680 | A1 * | 11/2005 | |
| GB | 1604091 | A * | 12/1981 | E04F 21/08 |
| KR | 900002695 | Y1 * | 3/1990 | F24F 13/02 |
| WO | WO 96/01389 | * | 1/1996 | F16L 59/04 |
| WO | WO 96/41983 | * | 12/1996 | F16L 21/08 |

OTHER PUBLICATIONS

Google, Blow Wool Material, 1 page.*
Merriam Webster, Relationship Definition, 1 page, https://www.merriam-webster.com/dictionary/relationship.*
Merriam Webster, Through Definition, 1 page, https://www.merriam-webster.com/dictionary/through.*

* cited by examiner

COMMERCIAL KITCHEN INSTALLATION WITH DOUBLE WALL GREASE DUCT

RELATED APPLICATIONS

This application is a continuation of U.S. patent application Ser. No. 16/868,610, filed 7 May 2020, the disclosure of which is incorporated by reference herein in its entirety.

FIELD OF THE INVENTION

The present invention relates to commercial kitchen installations, and more particularly to a commercial kitchen installation including a grease duct.

BACKGROUND OF THE INVENTION

Unfortunately, commercial kitchen grease duct fires occur, sometimes resulting in substantial property damage. There are various reasons for grease duct fires. Some result from a flare-up at a stove or grill top. If the fire is not suppressed, the fire can spread quickly into the duct system. In some cases, hidden grease duct fires occur and are not immediately detected. Sometimes these fires remain undetected until the combustion supply is depleted. Even though temperatures may spike under certain conditions, an effective fire resistive enclosure may protect areas around the grease duct and even the structure housing the commercial kitchen. With sufficient grease duct fuel and oxygen, however, a fire will not burn out quickly, but can grow to involve the entire duct with internal temperatures rising to as high as 2000° F., depending on duct size, grease containment levels and available combustion air. Thus, this potential for grease duct fires underscores and emphasizes the need for effective fire resistive enclosures for grease ducts.

SUMMARY OF THE INVENTION

The present invention relates to a commercial kitchen having a grease duct assembly that directs grease-laden air from a kitchen hood. The grease duct assembly comprises multiple grease duct sections secured end-to-end. Each grease duct section is of a double wall construction that forms a central conduit and an annular space around the central conduit. Shredded insulation is compressed into the annular space and this results a highly efficient fire resistive grease duct assembly.

The present invention also entails a process of filling shredded insulation into the double wall grease duct section which includes an outer wall, an inner wall, a central conduit disposed inside the inner wall and wherein the outer and inner walls define an annular space that includes first and second openings on two ends of the grease duct section. The process includes inserting a grease duct into a support. Sealing the first opening of the annular space and preventing substantial air from escaping the annular space via the first opening during the insulation filling process. The process further includes moving a plurality of insulation filling heads towards the second opening of the annular space and engaging the filling heads with the second opening and employing the insulation filling heads to seal the second opening. Thereafter, shredded insulation is directed under pressure to the filling heads which in turn blow the shredded insulation from the filling heads through the second opening into the annular space. During the course of blowing the shredded insulation into the annular space, the shredded insulation is compressed into the annular space. While insulation is being blown into the annular space, there is a need to exhaust air from the annular space. This is achieved in one embodiment by designating one or more filling heads to blow in the insulation and one or more filling heads to exhaust air from the annular space.

In one particular embodiment, each grease duct section includes a central flange projecting from an inner wall and past the outer wall of the section. Two grease duct sections are secured end-to-end by first abutting the central flanges together. A first fastener, such as a V-band, engages the two central flanges and extends around the flanges and secures them together. A second flange, such as a double V-band, is secured to outer flanges projecting from the ends of the outer walls. This second fastener extends over the two central flanges and effectively couples the outer walls of the two sections together.

In one embodiment, a sealant, such as a fire barrier silicone, is applied to the engaging surface of the first fastener. Moreover, the sealant can be applied externally and internally to the joint made by the two central flanges. Likewise, a sealant can be applied to the engaging surfaces of the second fastener.

Another aspect of the present invention is that the grease duct assembly comprises a plurality of grease duct sections secured together. Many of the sections are modular and interchangeable. This enables the configuration of the grease duct assembly to be easily adapted to various commercial kitchen environments.

Other objects and advantages of the present invention will become apparent and obvious from a study of the following description and the accompanying drawings which are merely illustrative of such invention.

DESCRIPTION OF EXEMPLARY EMBODIMENTS

Figure 1:
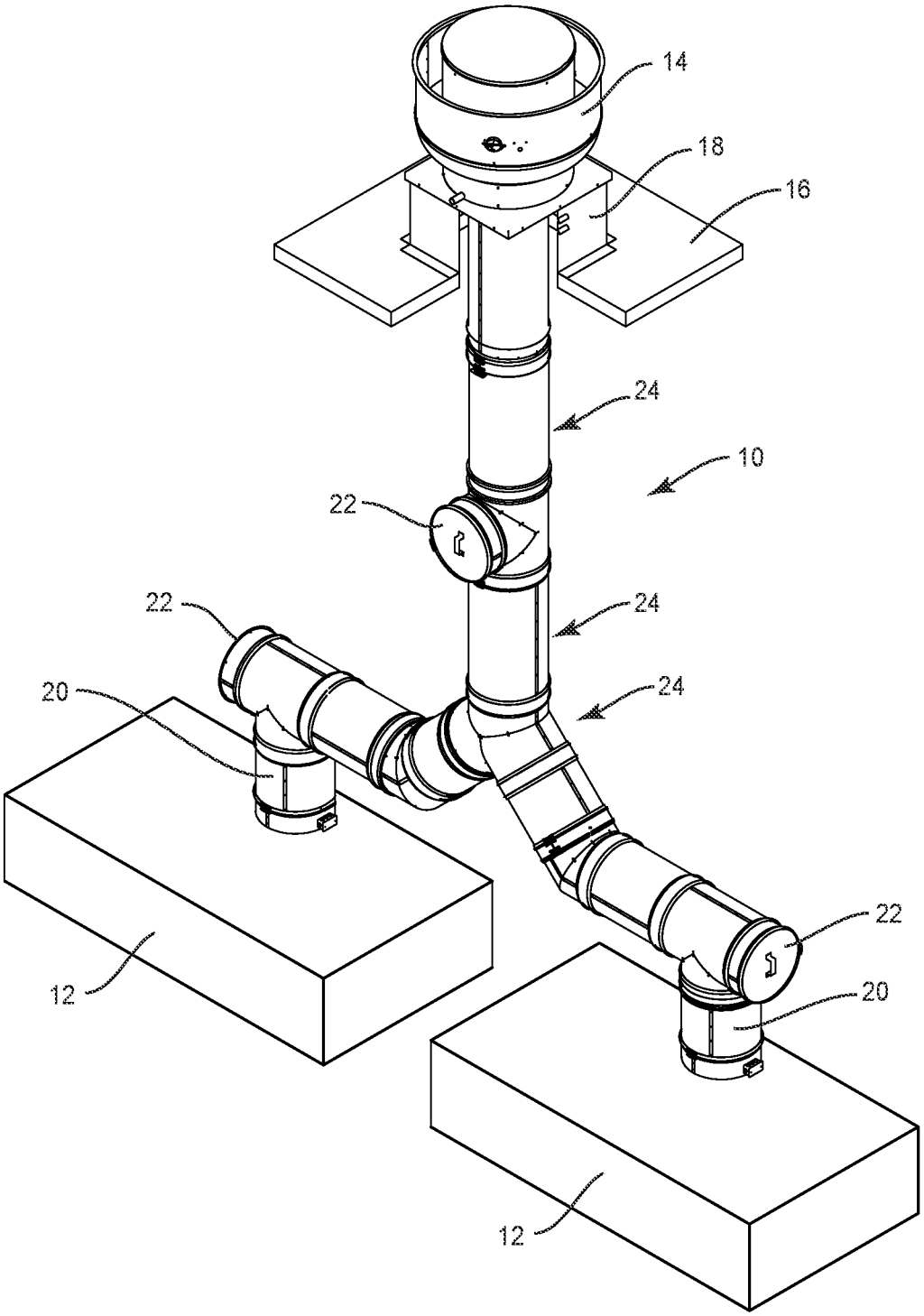
FIG. 1 is a perspective view of a grease duct assembly shown operatively interconnected between a pair of kitchen hoods and a rooftop exhaust fan.
Figure 2:
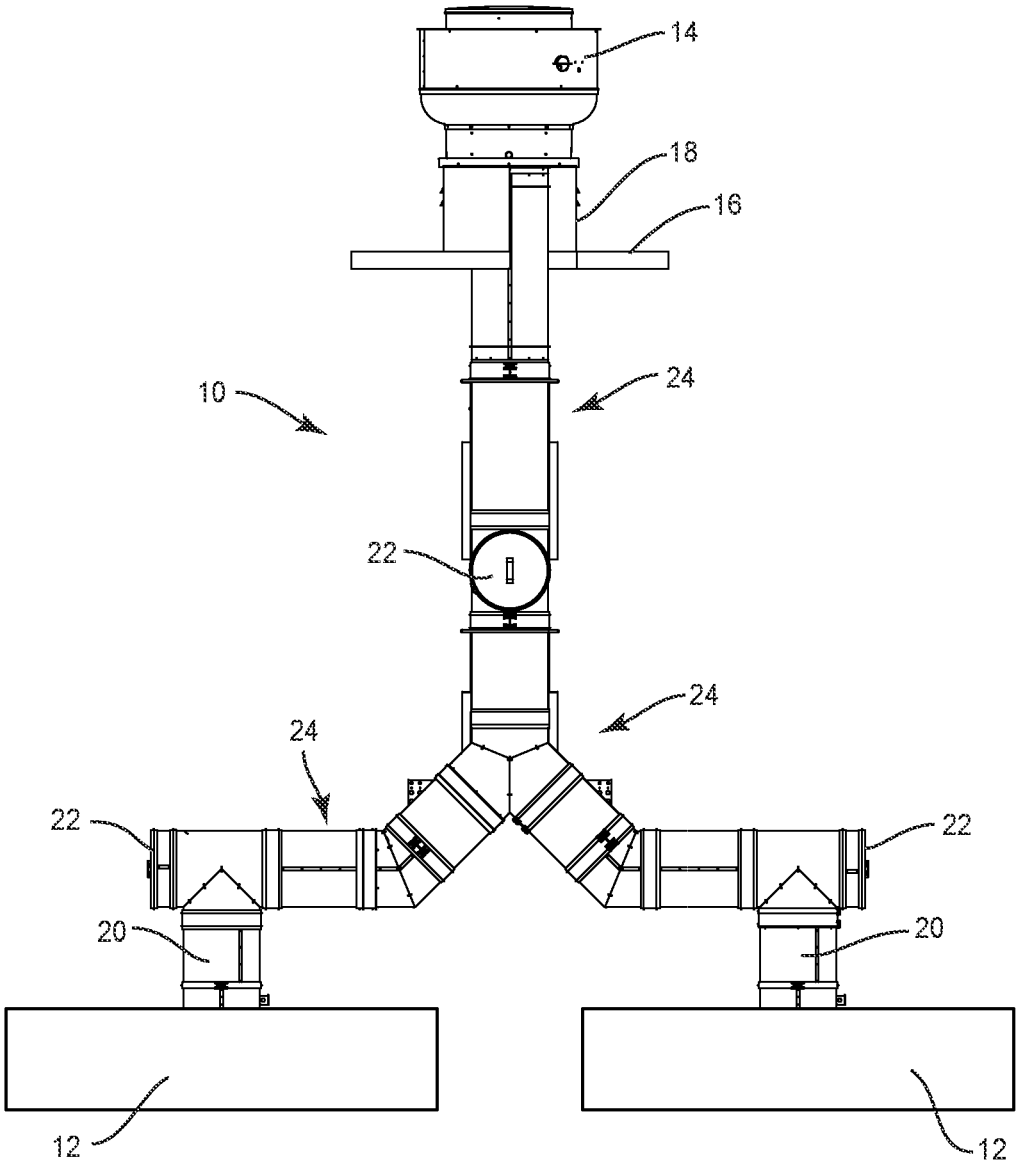
FIG. 2 is a front elevational view of the grease duct assembly shown in FIG. 1.

With further references to the drawings, particularly FIG. 1, the grease duct assembly 10 of the present invention is shown therein and indicated generally by the numeral 10. Grease duct assembly 10 is typically installed in a commercial kitchen and is utilized to exhaust grease-laden air from one or more kitchen hoods 12. As seen in FIG. 1, grease duct assembly 10 is bifurcated at the lower end so as to accommodate two kitchen hoods 12. It is appreciated, however, that the grease duct assembly 10 of the present invention can simply serve one exhaust hood 12 or multiple exhaust hoods.

As seen in FIG. 1, the bifurcated legs of the grease duct assembly 10 extend inwardly to where they turn and join the vertical section of the grease duct assembly. The vertical section of the grease duct assembly 10 extends upwardly through a roof 16 of the structure housing the commercial kitchen. Secured to the roof 16 is a vented curb 18. The upper portion of the vertical section of the grease duct assembly 10 extends through the curb 18 and is operatively connected to the exhaust fan 14 which is supported by the curb 18.

Viewing the grease duct assembly 10 in more detail, a riser 20 is operatively connected between one of the kitchen hoods 12 and an end portion of one of the bifurcated legs. As discussed below, the grease duct assembly 10 is made up of a series of grease duct sections 24 that are joined end-to-end. Note the two lower legs of the grease duct assembly 10 include multiple straight and elbow-shaped sections coupled together. Likewise, the vertical portion of the grease duct assembly 10 includes multiple straight sections joined end-to-end. In one embodiment, the straight and elbow sections are each a standard length or size. This means that it may be advantageous for the uppermost grease duct section to be adjustable in length so as to appropriately connect to the exhaust fan 14. The adjustable section can be fabricated in the field. Alternatively, standard straight length sections can be fitted with an intervening adjustable collar to yield a length that fits between a standard length section and the exhaust fan 14. Continuing to refer to FIG. 1, the grease duct assembly 10 includes a series of access openings 22 provided in various sections 24. This permits the interior of the grease duct assembly 10 to be inspected, cleaned and maintained.

Figure 3:
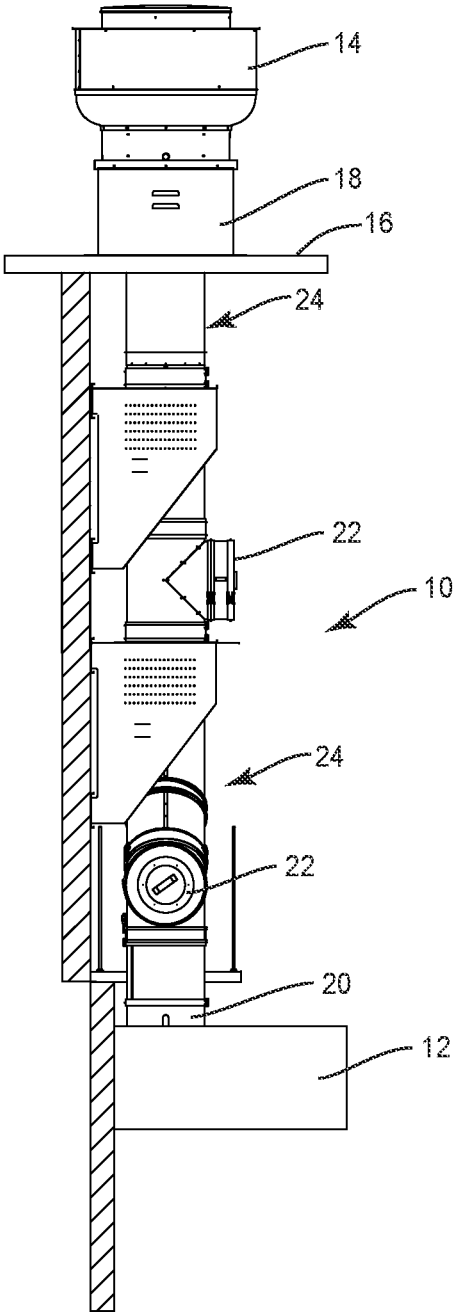
FIG. 3 is a side view showing the grease duct assembly of FIG. 1.

There are various ways of supporting the grease duct assembly 10 in a commercial kitchen. One example is shown in FIG. 3. Here, a series of gussets or support plates that are connected to the grease duct assembly 10 are tied into an adjacent wall. Other supports can be employed to support the horizontal legs of the grease duct assembly 10.

Figure 4:
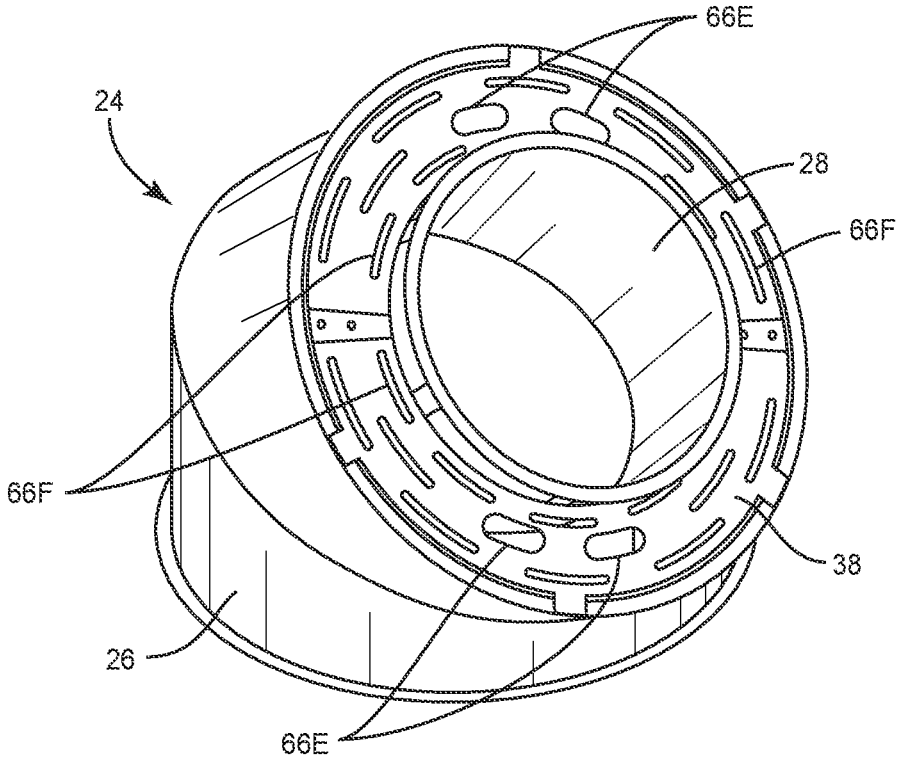
FIG. 4 is a perspective view of a grease duct section that is used in the grease duct assembly.
Figure 5:
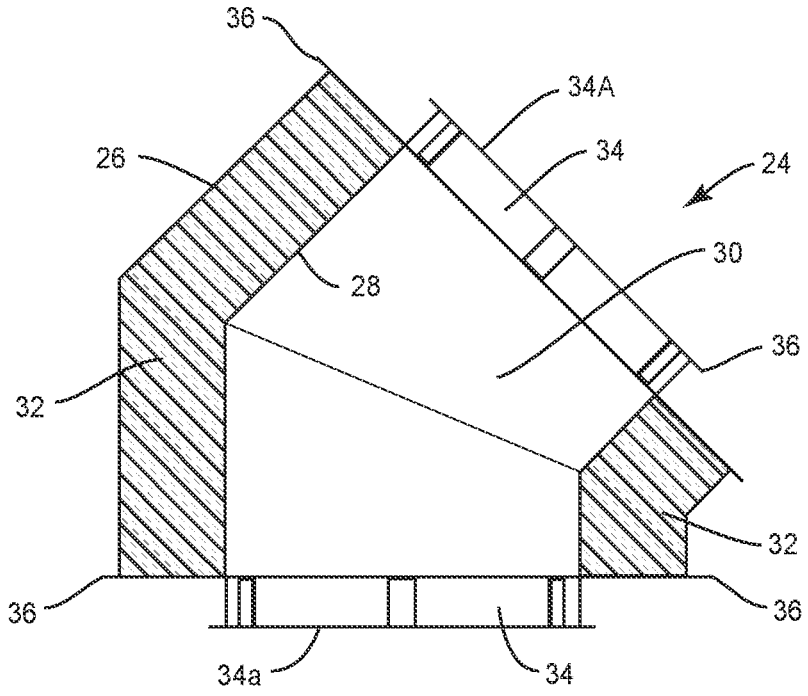
FIG. 5 is a cross-sectional view of the grease duct section shown in FIG. 4.
Figure 6:
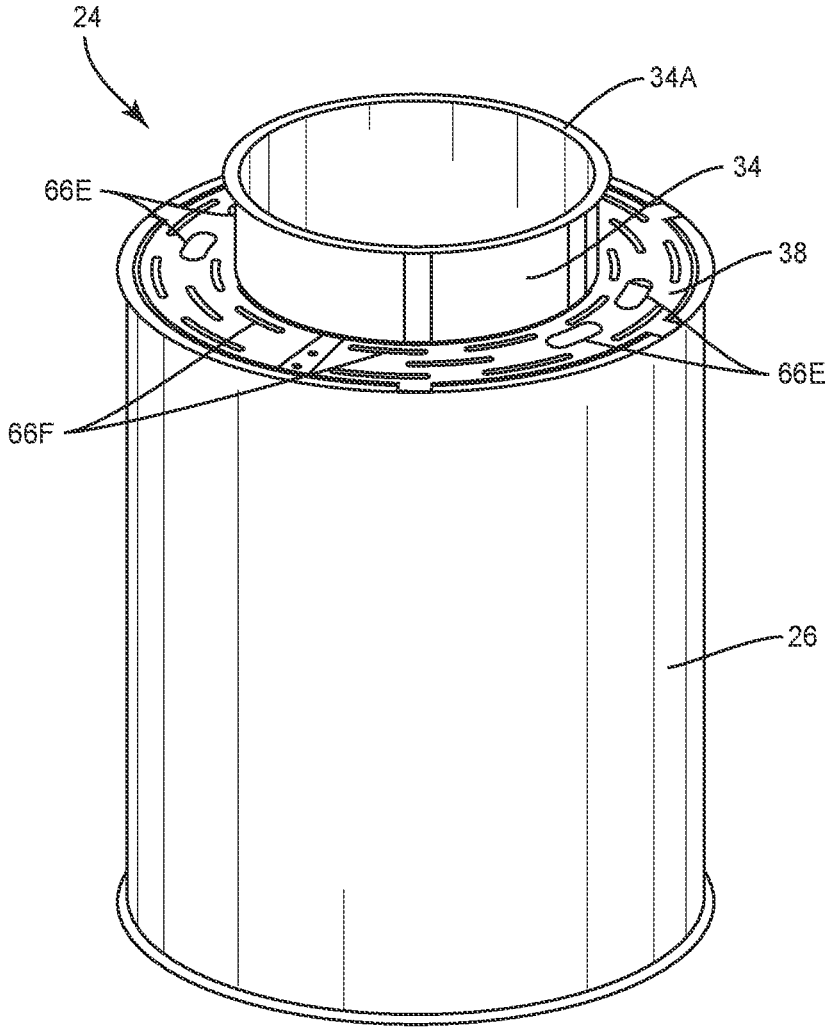
FIG. 6 is a perspective view of a straight grease duct section.

The present invention entails a unique way of constructing the grease duct assembly 10. This revolves around providing a unique grease duct section design that can be readily connected and sealed to another section and which can be applied in many different configurations. FIGS. 4-6 show two grease duct sections 24. It is appreciated that the design, dimensions and shape of the sections 24 can vary. Thus, the embodiments shown in FIGS. 4-6 are exemplary embodiments of two standard duct sections 24. The grease duct section 24 shown in FIGS. 4 and 5 is what is referred to as an elbow section. It can be used as shown in FIG. 1 to effectively turn the horizontal leg portions of the grease duct assembly 10 to meet the vertical portion. FIG. 6, on the other hand, is an example of a straight grease duct section. FIGS. 4-6 show two types of grease duct sections. There can be other configurations, such as, for example, a grease duct section that is in the form of a T-section.

Viewing FIGS. 4-6, each section 24, whether an elbow section or a straight section, is of a double wall construction. That is, each section includes an outer wall 26 and an inner wall 28. Defined interiorly of the inner wall 28 is a central conduit 30 through which air being exhausted from the kitchen hoods 12 passes. Further, the double wall construction gives rise to an annular space defined between the outer wall 26 and the inner wall 28 (see FIG. 5). Formed about opposite ends of the sections 24 is a central flange 34. Central flange 34 is an extension of the inner wall 28. Note that the central flange 34 projects from opposite ends of the section 24 and past the terminal ends of the outer wall 26 (see FIG. 5). Note also that the central flange 34 includes an outer flared lip 34A. See FIG. 6. In addition, the outer wall 26 includes a pair of outer flanges 36 that project outwardly from opposite ends of the outer wall 26.

Each section 24 is provided with an end cap 38. See FIGS. 4 and 6. Each end cap 38 extends from the inner wall 28 outwardly towards the outer wall 26 and effectively caps the annular space defined between the outer wall 26 and the inner wall 28. Note that the end caps 38 include openings formed therein. As will be discussed later, the openings in the end caps 38 accommodate insulation injection heads that are used in filling the annular space with shredded insulation. Also, the end caps 38 have a structural function. They effectively support the outer wall 26 from the inner wall 28 and provide rigidity to the grease duct section 24. The end caps 38 are welded or secured by other suitable means to the outer and inner walls 26, 28 and hence the end caps structurally support the outer wall around the inner wall.

Shredded insulation is placed and compressed into the annular space of the section 24. See FIG. 5 where the compressed shredded insulation is referred to by the numeral 32. The degree of compression can vary but in general the shredded insulation is compressed sufficiently to comply with appropriate regulations. There are various ways to fill and compress the shredded insulation into the annular space of the duct section. In one example, the duct section 24 is loaded into a fixture that holds and supports the duct section and also functions to engage the section in such a way that the section can be pressurized. Once in the fixture, the process of filling and compressing the shredded insulation is automated. In the way of an example, a segmented filling head compresses around the duct section 24. Insulation injection nozzles on the filling head align with openings in the upper disposed end cap 38. Thereafter, shredded insulation from a source is injected under pressure into the annular space and the injection process continues to fill the annular space until a specified pressure is met. Once pressure is met, the filling heads pull away from the duct section and the duct section can be weighed and unloaded from the fixture. This shredded insulation filling process is illustrated in FIGS. 8-11 and is discussed further below. The system for filling and compressing the shredded insulation into the annular space can include a ring plunger but it is not used in a process where the annular space is capped on the ends.

Figure 7A:
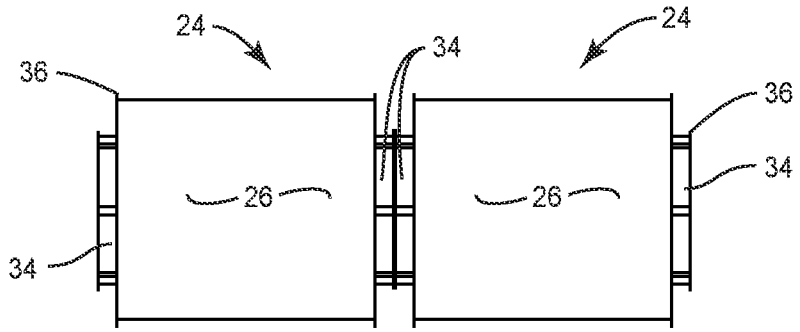
FIGS. 7A-7D are a sequence of views that illustrate how the grease duct sections are connected together.

FIGS. 7A-7D depict how two grease duct sections 24 can be sealed and connected. This illustrates two straight grease duct sections. However, it is appreciated that the same method or process can be utilized in connecting two elbow sections together or an elbow and straight section together. In any event, in this case the two grease duct sections 24 are aligned as shown in FIG. 7A. The sections are brought together such that the central flanges 34 abut and form a joint. A first coupler or fastener 40 (such as a V-band) is extended around the two central flanges 34 and the joint formed thereby. One example of a suitable coupler or fastener is a device known as a V-band. Details of the V-band are not dealt with herein because such is not per se material to the present invention and because people skilled in the art understand how V-bands are used to secure structures together. Suffice it to say that a V-band is a clamping device. V-bands are designed to encircle a joint between two structures that are to be connected. In some V-bands, a bolt and nut arrangement allows the band to be tightened around the joint and a portion of the two structures being connected to effectively clamp the two structures together. In any event, to secure the two central flanges 34 together, the V-band extends across the joint formed by the central flanges 44. The V-band engages the lips 34A of the flanges 34. Thereafter, the V-band is tightened around the joint effectively pulling the two central flanges together and securing them.

Prior to installing the V-band, the V-band can be filled with a fire barrier silicone sealant. Once the V-band 40 is secured around the joint, the silicone sealant forms a sealed joint around the interface formed by the two abutting central flanges 34. As an option, a further silicone sealant bead can be applied internally to the joint. The goal is to make all of the joints in the grease duct assembly 10 liquid tight. While a silicone sealant has been discussed above, it is appreciated by those skilled in the art that other types of sealants can be used.

Figure 7B:
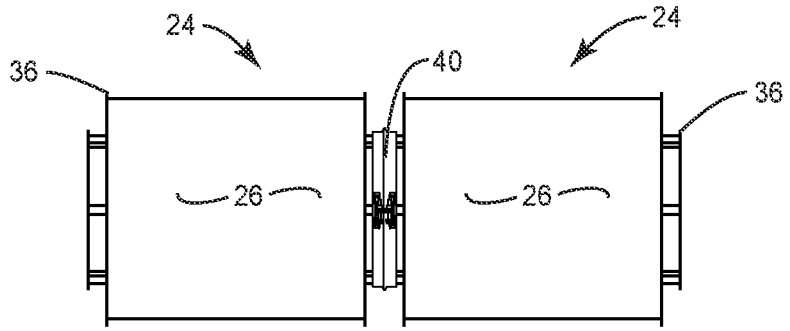
Figure 7C:
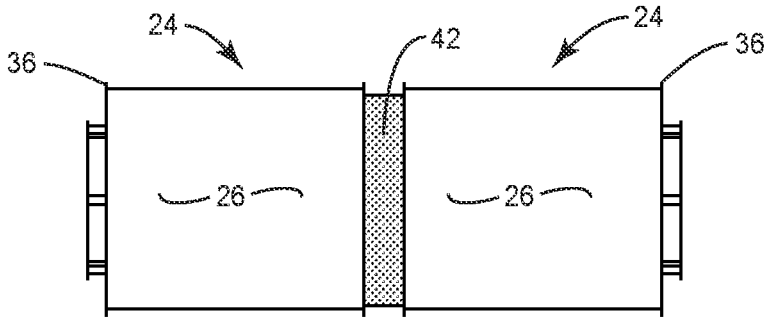
Figure 7D:
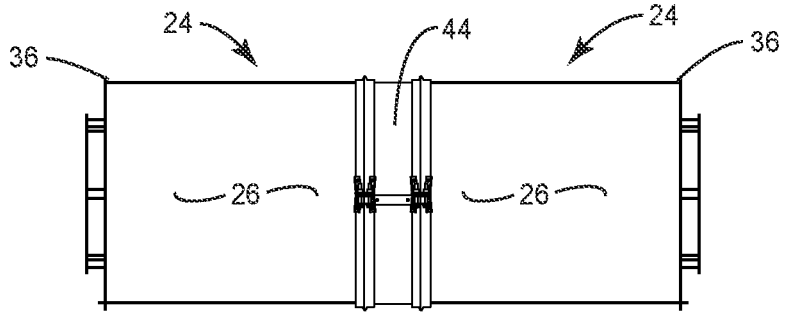

After the two central flanges 34 have been secured together by the V-band as shown in FIG. 7B, a strip of insulation 42 is wound around the central flanges 34 and the connecting V-band. Note in FIG. 7C where the strip of insulation 42 basically fills the gap between the two sections 24.

After the strip of insulation 42 has been applied, the next step entails connecting the outer walls 26 of the two sections. This is achieved by utilizing a second coupler or fastener. In the example illustrated in FIG. 7D, a double V-band 44 is employed. The double V-band 44 encircles the insulation strip 42 and the underlying central flanges 34. Each V-band of the double V-band engages an outer flange 36 of the outer wall 26 of one section. Thereafter, the double V-band 44 is tightened and forms a secure connection between the outer walls 26 of the two sections. Effectively, the double V-band spans the space between the outer walls 26 and forms a bridge between the outer walls of the two sections.

FIGS. 8-11 illustrate a process for filling the annular space of the grease duct sections 24 with shredded insulation. First, a grease duct section 24 is placed in a support or cradle 60. Various section configurations can be held in the support 60. In the examples shown in FIGS. 8-11, the grease duct section 24 is a T-section that comprises a straight section and a section that is joined into the side of the straight section, forming the T-section. Hence, the T-section includes three main openings through which grease laden air flows when used to form an operative grease duct assembly.

Figure 8:
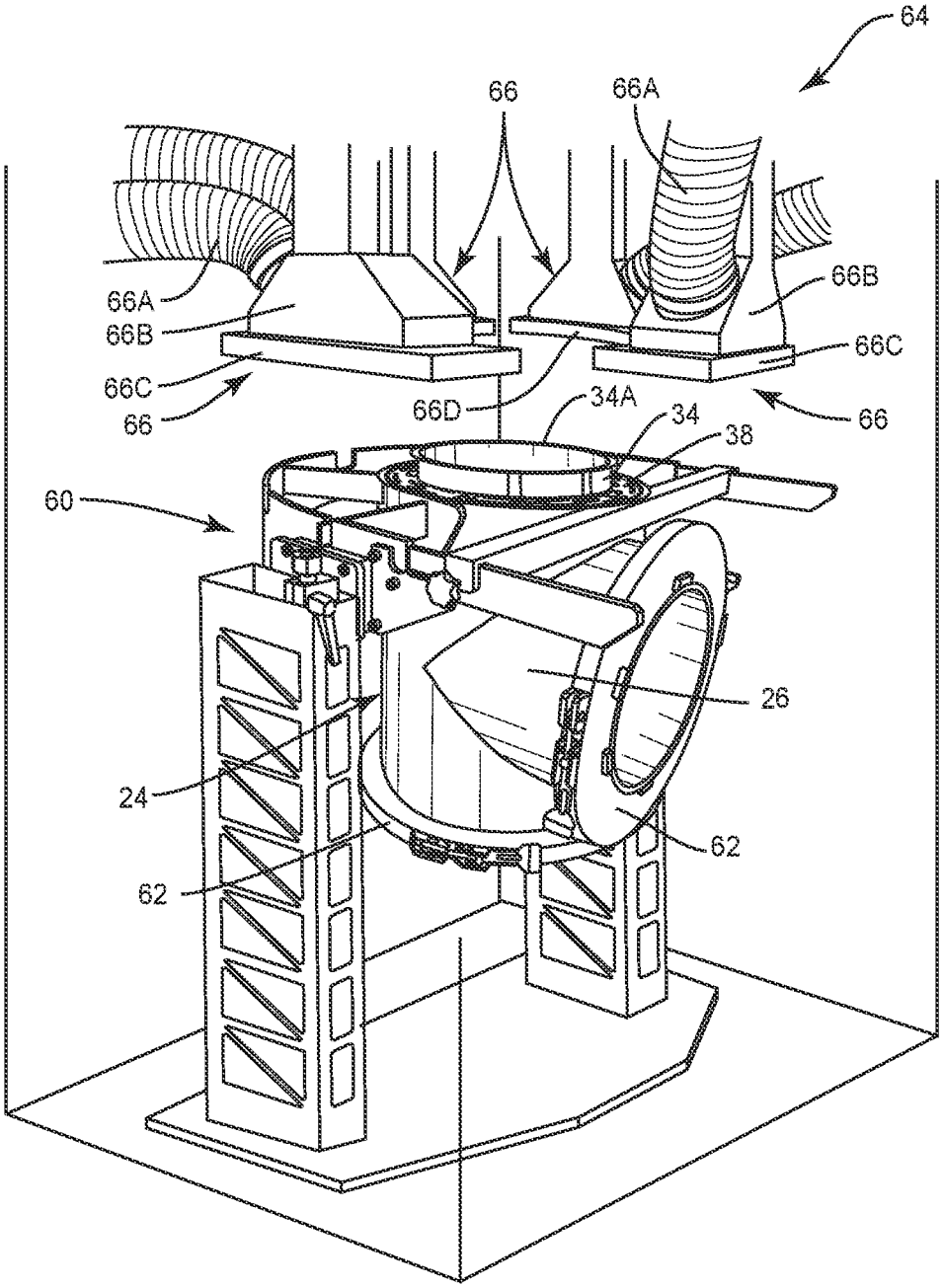
FIG. 8 is a schematic illustration showing the process for filling shredded insulation into the annular space of a grease duct section.
Figure 9:
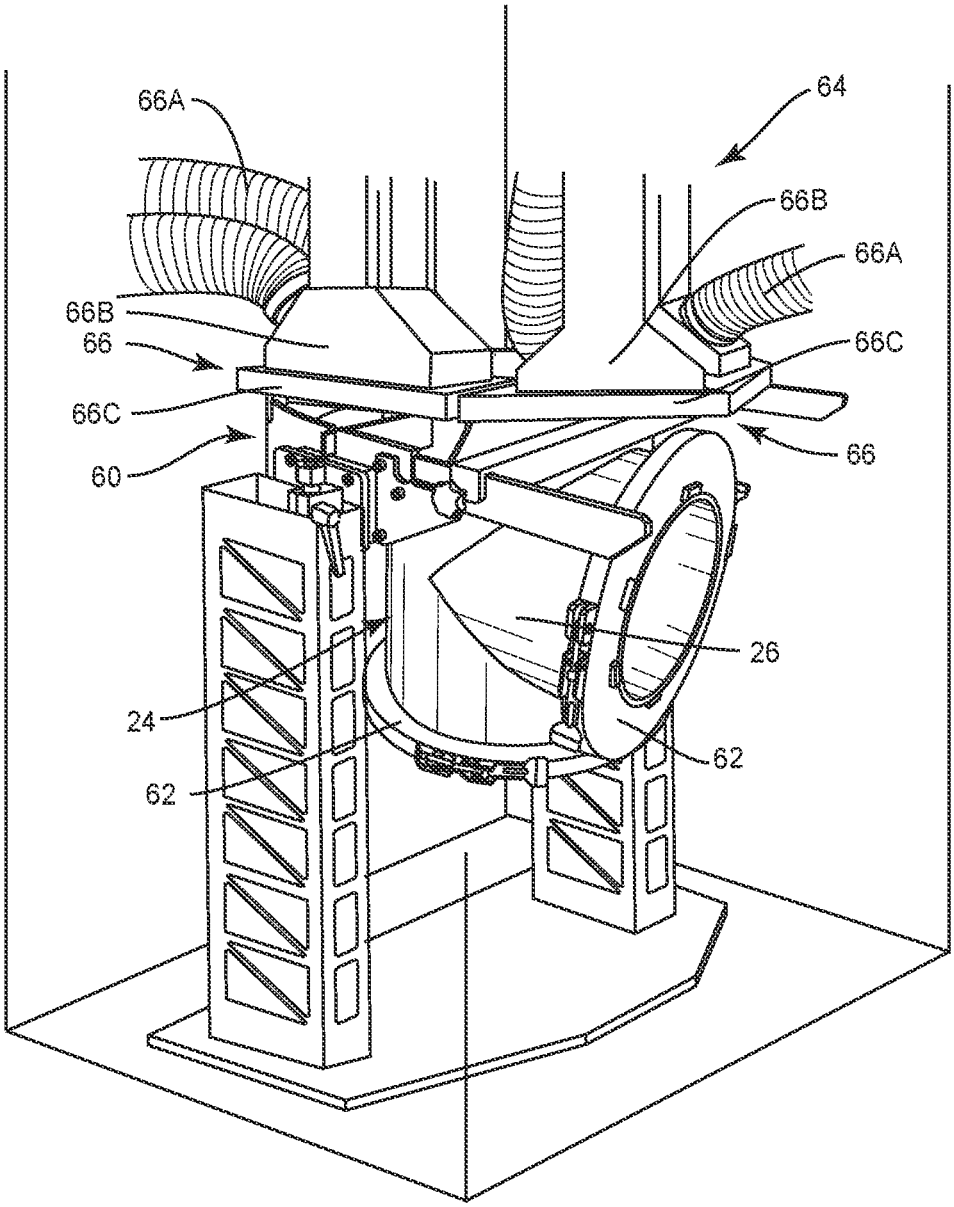
FIG. 9 is a schematic illustration similar to FIG. 8 but showing the shredded insulation filling heads in a lower position engaged with the top portion of a grease duct section.

The insulation filling process entails blowing shredded insulation under pressure into the annular space of the grease duct section and in the process compressing shredded insulation in the annular space. Hence, it is desirable to seal the annular space of the grease duct section to prevent significant or substantial amounts of air from escaping the annular space during the filling process. The openings to the lower and side annular spaces as viewed in FIGS. 8 and 9 are sealed. There are various ways of sealing these openings. As shown in FIGS. 8 and 9, sealing is achieved by annular or ring bands 62 that are clamped tightly over the end plates 38 that lie in the openings to these annular spaces. Hence, air is precluded from being discharged from the bottom and side of the T-shaped grease duct section 24 during the filling process.

Shredded insulation is filled from the top of the duct section 24 into the annular space of the section. The filling process entails the use of a segmented insulation filling head assembly 64 that includes in this example four separate insulation filling heads 66. These filling heads 66 are configured to move about the top of the held grease duct section and are configured to engage the top portion of the section during the filling process.

Viewing the individual filling head 66, it is seen that they have connected thereto a supply hose 66A. The supply hose leads from a shredded insulation source to the individual filling heads 66. Each supply hose 66A is connected to a housing 66B that is supported on a pad 66C. Note that the pad 66C includes an arcuate-shaped side edge 66D.

During the filling process, the pads 66C are tightly held over the perforated end cap 38 that is secured into the upper opening of the annular space. Hence, shredded insulation is blown under pressure through the hoses 66A, into the housing 66B and into the pads 66C which includes insulation outlets through which the insulation flows. Insulation outlets and air outlets are provided on the underside of the pads 66C and the outlets are aligned with selected openings in the end cap 38.

The insulation filling process is designed such that air can be exhausted from the annular space in the duct while insulation is being blown into the annular space. Note in FIG. 11 where opposed filling heads are used to blow in insulation while the other two opposed filling heads 66 exhaust air from the annular space. The annular end cap 38 is designed to make this possible while at the same time cooperating with the filling heads to seal the annular space. Note in FIG. 6 where there are relatively large openings 66E and relatively small openings 66F in the end cap 38. The relatively large opening 66E would align with the filling heads 66 blowing in the insulation and the small openings 66F would be aligned with the filling heads 66 that are designed to exhaust air from the annular space.

Figure 10:
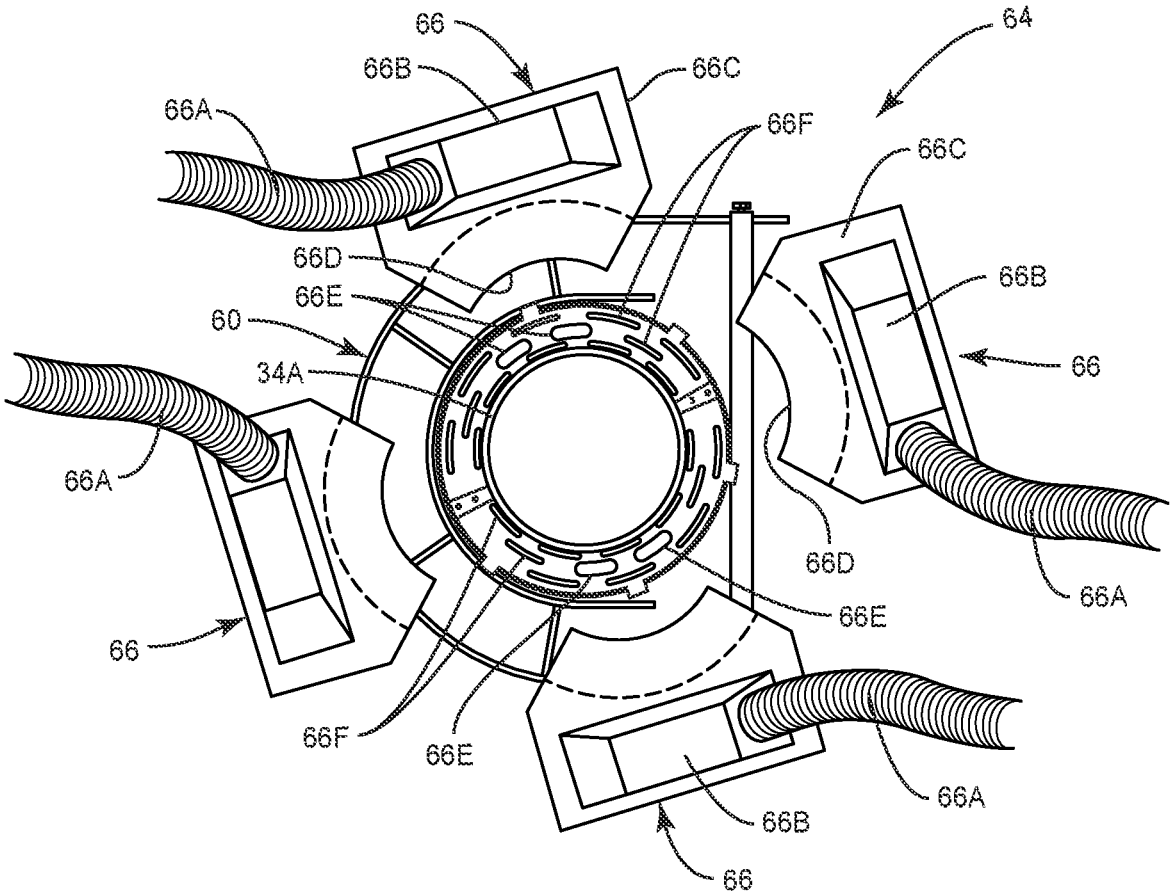
FIG. 10 is a top plan view showing the segmented filling head spaced away from the top portion of the supported grease duct section.
Figure 11:
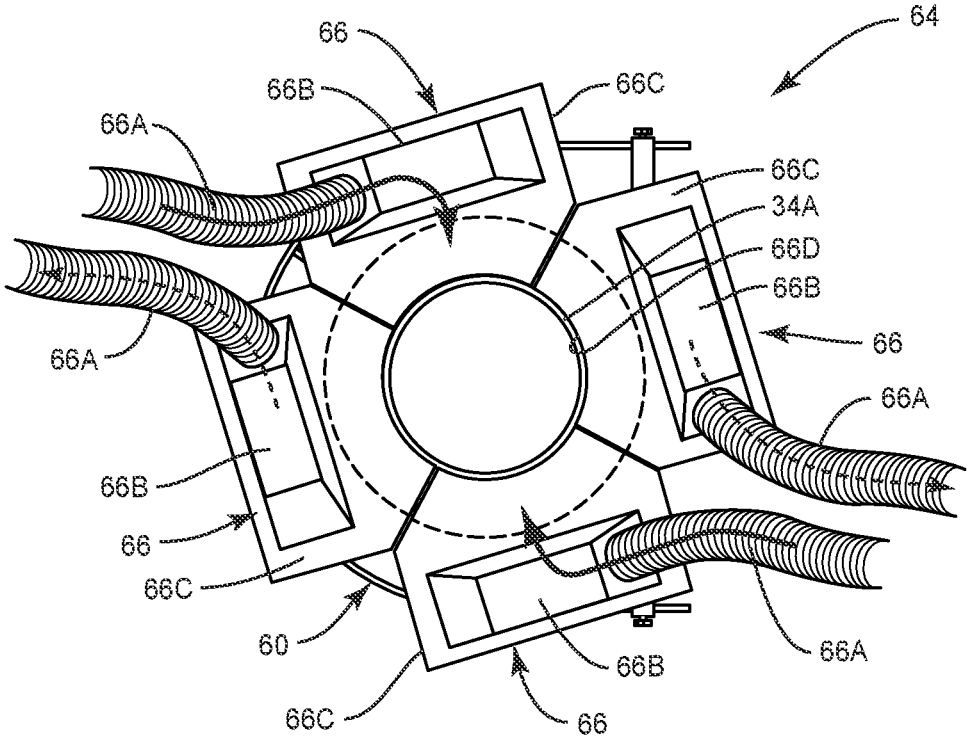
FIG. 11 is a view similar to FIG. 10 except that the shredded insulation of the filling head has been brought into engagement with the top portion of the grease duct section.

With reference to FIGS. 10 and 11, note that before filling occurs, the filing heads 66 are spaced above and outwardly from the top portion of the grease duct section 24. When it is desired to fill the annular space with shredded insulation, the filling heads 66 are moved inwardly towards the top portion of the supported grease duct section 24. The arcuate-shaped edges 66D are pressed into engagement with the central flange 34 that projects upwardly past the end plate 38. The filling heads are pressed downwardly around the end plate 38 so as to seal the top opening of the annular space. Once this relatively tight seal is achieved, shredded insulation is blown under pressure into the filling heads 66 and through the perforated openings in the end cap 38. Since the shredded insulation is blown under pressure and that the annular space is generally sealed, the filling process effectively compresses the shredded insulation into the annular space.

There are numerous advantages to the grease duct assembly 10 described above. First and foremost, the design of the grease duct assembly 10 provides an effective fire resistive structure. The grease duct assembly 10 can withstand continuous temperatures of up to 500° F. and intermittent temperatures up to 2000° F. Moreover, the modular design comprising the array of grease duct sections enables the grease duct assembly 10 to be quickly and easily constructed, even on site if appropriate. Moreover, by employing elbow and straight duct sections, grease duct configurations can be easily constructed for various specific applications. The present invention may, of course, be carried out in other specific ways than those herein set forth without departing from the scope and the essential characteristics of the invention. The present embodiments are therefore to be construed in all aspects as illustrative and not restrictive and all changes coming within the meaning and equivalency range of the appended claims are intended to be embraced therein.

What is claimed is:

1. A process for filling shredded insulation into a double wall grease duct section having an outer wall, an inner wall, a central conduit disposed inside the inner wall and wherein the outer and inner walls define an annular space that includes first and second openings on two ends of the grease duct section, the process comprising:

inserting the grease duct section into a support and supporting the grease duct section in the support while shredded insulation is being filled into the grease duct section;

sealing the first opening of the annular space and preventing substantial air from escaping the annular space via the first opening during the insulation filling process;

moving a plurality of insulation filling heads towards the second opening of the annular space;

engaging the insulation filling heads with the second opening of the annular space and employing the insulation filling heads to seal the second opening;

directing shredded insulation under pressure to at least one of the insulation filling heads;

blowing the shredded insulation from the at least one of the insulation filling heads and through the second opening and into the annular space;

wherein blowing the shredded insulation into the annular space compresses the shredded insulation into the annular space;

wherein the plurality of insulation filling heads includes a first insulation filling head and a second insulation filling head and wherein each insulation filling head includes a housing supported on a pad;

wherein the second opening includes a perforated annular end plate;

wherein the process includes engaging the perforated annular end plate with the first and second insulation filling heads and holding the pads of the first and second insulation filling heads against the perforated annular end plate and forming a sealed relationship between the first and second insulation filling heads and the perforated annular end plate;

blowing insulation and air from the first insulation filling head through openings in the perforated annular end plate into the annular space; and while blowing insulation and air from the first insulation filling head into the annular space, exhausting air from the annular space through the perforated end plate into the second insulation filling head.

2. The process of claim 1 wherein each pad of the first and second insulation filling head includes an arcuate-shaped edge, and wherein the grease duct section includes a central flange; and wherein the process includes pressing the arcuate-shaped edge of the pads against the central flange of the grease duct section while insulation is being blown into the annular space.

3. The process of claim 2 wherein the plurality of insulation filling heads includes four insulation filling heads with each filling head including the pad having the arcuate-shaped edge; and wherein the process includes engaging each of the pads of the four insulation filling heads with the central flange of the grease duct section during the process of filling the annular space with shredded insulation.

4. The process of claim 1 wherein the perforated annular end plates include a plurality of openings that are larger than another plurality of openings and wherein the process includes directing the shredded insulation through the plurality of openings and exhausting air from the annular space through the another plurality of openings.

5. A process for filling shredded insulation into a double wall grease duct section having an outer wall, an inner wall, a central conduit disposed inside the inner wall, and wherein the outer and inner walls define an annular space that includes first and second openings on opposed ends of the grease duct section;

wherein the inner wall includes an extension that forms a central flange that projects past a terminal end of the outer wall; wherein there is a perforated annular end cap that extends over the second opening of the annular space and extends around the central flange;

the process comprising:

inserting the grease duct section into a support and supporting the grease duct section in the support while shredded insulation is being filled into the grease duct section;

sealing the first opening of the annular space and preventing substantial air from escaping the annular space via the first opening during the insulation filling process;

moving a plurality of insulation filling heads towards the perforated annular end cap that extends over the second opening;

wherein each insulation filling head includes an outlet end;

engaging the central flange with the outlet ends of the insulation filling heads;

engaging an outer side of the perforated annular end cap with the outlet ends of the insulation filling heads;

forming a seal relationship between the outlet ends of the insulation filling heads and the outer side of the perforated annular end cap; and discharging shredded insulation from the outlet end of at least one of the insulation filling heads where, after being discharged from the outlet end of at least one of the insulation filling heads, the shredded insulation passes into and through the perforated annular end cap and after passing through the perforated annular end cap, the shredded insulation passes into the annular space.

6. The process of claim 5 wherein each outlet end of the insulation filling heads includes a pad and wherein the pad includes an arcuate-shaped edge, and wherein the process includes pressing the arcuate-shaped edge of the pads against the central flange of the grease duct section while insulation is being discharged into the annular space.

7. The process of claim 6 wherein the perforated annular end cap separates the annular space from the outlet ends of the insulation filling heads.

8. A process for filling shredded insulation into a double wall grease duct section having an outer wall, an inner wall, a central conduit disposed inside the inner wall and wherein the outer and inner walls define an annular space that includes first and second openings on two ends of the grease duct section, the process comprising:

inserting the grease duct section into a support and supporting the grease duct section in the support while shredded insulation is being filled into the grease duct section;

sealing the first opening of the annular space and preventing substantial air from escaping the annular space via the first opening during the insulation filling process;

moving a plurality of insulation filling heads towards the second opening of the annular space;

engaging the insulation filling heads with the second opening of the annular space and employing the insulation filling heads to seal the second opening;

directing shredded insulation under pressure to at least one of the insulation filling heads;

blowing the shredded insulation from the at least one of the insulation filling heads and through the second opening and into the annular space;

wherein blowing the shredded insulation into the annular space compresses the shredded insulation into the annular space;

wherein engaging the insulation filling heads with the second opening of the annular space and employing the insulation filling heads to seal the second opening includes engaging the insulation filling heads with the second opening to prevent significant or substantial air from escaping the annular space during the insulation filling process; and wherein each insulation filling head includes a pad disposed on a terminal end thereof and wherein the second opening includes a perforated end plate; and wherein the process includes engaging the perforated end plate with first and second insulation heads of the plurality of insulation filling heads and holding the pads of the first and second insulation filling heads against the end plate and forming a sealed relationship between the pads and the perforated end plate.

* * * * *